United States Patent [19]

Dassler

[11] 4,404,759

[45] Sep. 20, 1983

[54] ATHLETIC SHOE, ESPECIALLY JOGGING SHOE

[75] Inventor: Armin A. Dassler, Herzogenaurach, Fed. Rep. of Germany

[73] Assignee: PUMA-Sportschuhfabriken Rudolf Dassler KG, Herzogenaurach, Fed. Rep. of Germany

[21] Appl. No.: 296,772

[22] Filed: Aug. 27, 1981

[30] Foreign Application Priority Data

Aug. 27, 1980 [DE] Fed. Rep. of Germany ... 8022761[U]

[51] Int. Cl.[3] ..... A43B 5/00; A43B 13/04

[52] U.S. Cl. ..... 36/129; 36/59 C; 36/32 R

[58] Field of Search ..... 36/28, 29, 30 R, 32 R, 36/128, 129, 114, 126, 59 R, 59 C, 134

[56] References Cited

U.S. PATENT DOCUMENTS 3,555,697 1/1971 Dassler ..... 36/129
4,255,874 3/1981 Sironi ..... 36/32 R
4,297,796 11/1981 Stirtz ..... 36/32 R

FOREIGN PATENT DOCUMENTS 1097064 10/1981 Canada ..... 36/32 R
224626 12/1942 Switzerland ..... 36/59 R

*Primary Examiner*—Werner H. Schroeder
*Assistant Examiner*—Steven N. Meyers
*Attorney, Agent, or Firm*—Antonelli, Terry & Wands

[57] ABSTRACT

An athletic shoe, especially a jogging shoe, consisting of a tread sole made of rubber or a rubber-like synthetic resin, which sole is provided at least partially with cleat-like projections distributed over the tread surface and provided at the rim of the sole with additional cleat-like projections subdivided in the manner of a link chain. To create a fully elastic athletic shoe for jogging or other training purposes, wherein the cleat-like projections are to have a relatively low height in order to save weight, wherein yet a satisfactory gripping effect is to be ensured even under unfavorable ground conditions, the cleat-like projections are fashioned, on their sides which come into contact with the ground, with blade-like projections extending essentially in parallel to one another, which increase the shock-absorbing effect and simultaneously enhance the gripping effect.

23 Claims, 5 Drawing Figures

Fig. 2
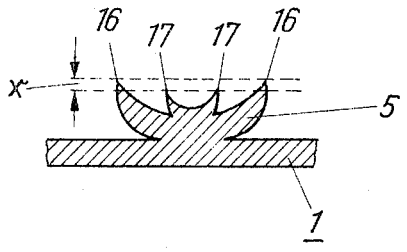
Fig. 3
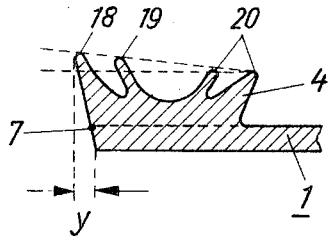
Fig. 4
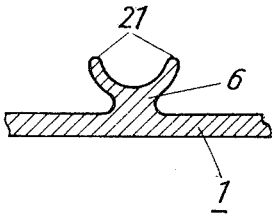
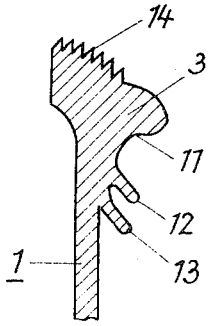
Fig. 5
Fig. 1
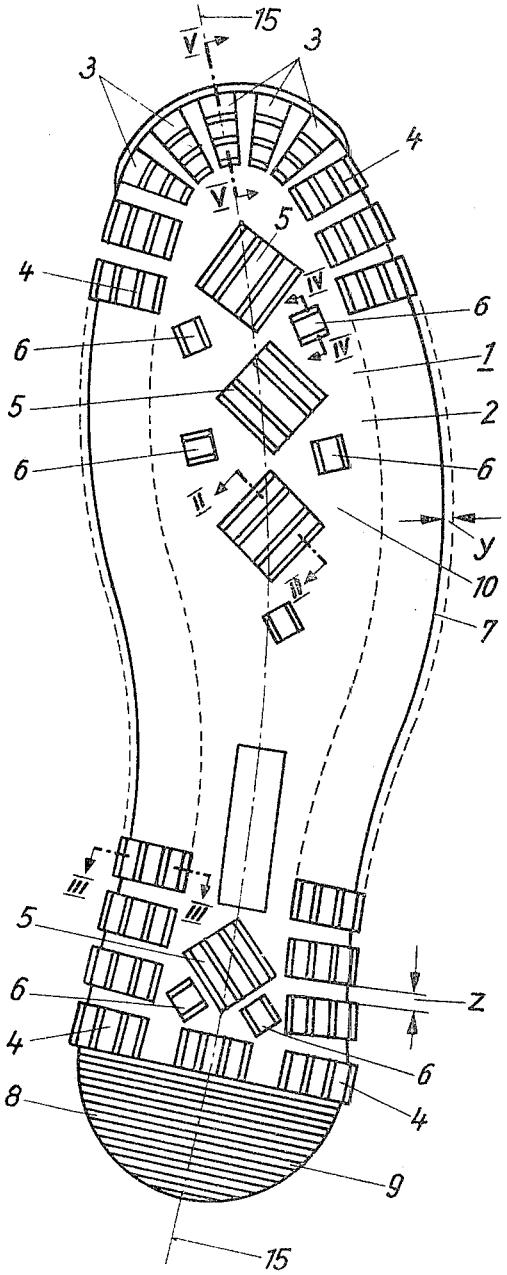

ATHLETIC SHOE, ESPECIALLY JOGGING SHOE

BACKGROUND AND SUMMARY OF THE INVENTION

The invention relates to an athletic shoe, especially a jogging shoe, with a tread sole formed of rubber or a rubber-like synthetic resin, which sole is provided at least partially with cleat-like projections distributed over the tread surface and, at the rim of the sole, with additional cleat-like projections subdivided in the manner of a link chain.

Tread soles with such cleat configurations are known in ski boots and mountaineers' shoes. However, these conventional soles cannot be used for jogging shoes since they are too heavy and cannot solve the problem underlying this invention, residing above all in providing a fully elastic athletic shoe for jogging or training purposes, the tread sole of which has cleat-like projections [protuberances] with a relatively low height, which shoes also exhibit a good gripping action even under unfavorable terrain conditions. Furthermore, by the configuration of the profiles as well as by their arrangement, a more pronounced spreading and gripping effect is to be achieved than known heretofore, ensuring for the athlete a high stability with adequate shock absorption in spite of the use of a relatively soft material, without the necessity of excessive deformations of the profiled elements.

According to a preferred embodiment of the invention, this complex problem has been solved by the feature that the cleat-like projections are provided, on their contact surfaces which are directed toward the ground, with blade-like projections which increase the shock-absorbing effect and simultaneously enhance the gripping effect, these blade-like projections extending essentially in parallel to one another.

To increase the nonskid property and to ensure high resiliency comfort even with smaller nub heights, it is advantageous, in accordance with a further feature of the invention, if the height of the cleat-like projections and/or of the blade-like projections rises from the inner part of the sole to the outer rim of the sole.

In order to improve the gripping effect, it is furthermore advantageous if the blades associated with the sole rim project past the sole rim.

It is also advantageous along the same lines if the inner portion of the sole encompassed by the cleat-like projections is provided at least partially with additional cleat-like projections having a rectangular and/or square basic shape.

It is likewise of advantage for solving the posed problem if the cleat-like projections arranged along the rim of the sole have a length of about 2 cm, a width of 1 cm, and a height of 3–8 mm, and the mutual spacing is about 2–5 mm.

Especially good results regarding the shock-absorbing effect and the gripping action have been obtained if the cleat-like projections arranged at the sole rim are equipped with blades arranged in pairs with respect to each other, of which at least one blade pair is oriented toward the inner part of the sole and at least one further blade pair is oriented toward or past the sole rim to the outside.

To ensure adequate gripping action also in the running direction, for example during starting, it is furthermore advantageous if at least the cleat-like projections arranged in the region of the tip of the shoe are provided with two or more differently large, claw-like blades, of which the largest blade is located directly at the sole rim and the other, smaller blades are oriented toward the inner part of the sole.

These and other objects, features and advantages of the present invention will become more apparent from the following description when taken in connection with the accompanying drawings.

BRIEF DESCRIPTION OF THE DRAWINGS

FIG. 1 shows a bottom plan view of the tread sole according to the invention;

FIG. 2 shows a cross section of a partial sole with a cleat-like projection along line II—II of FIG. 1;

FIG. 3 shows a cross section of a partial sole at the sole rim along line III—III of FIG. 1;

FIG. 4 shows a cross section of a partial sole with a cleat-like projection equipped with a blade pair, along line IV—IV of FIG. 1; and FIG. 5 shows a cross section of a partial sole with a cleat-like projection in a lateral view, as arranged in the zone of the tip of the shoe, along line V—V of FIG. 1.

DETAILED DESCRIPTION OF THE PREFERRED EMBODIMENT

The athletic shoe of this invention has a tread sole 1, the actual tread surface of which is denoted by 2. The tread surface is provided with cleat-like projections 3, 4, 5 and 6, of which the projections denoted by 3 and 4 are arranged in the manner of a link chain on the sole rim 7 up to the rearward portion 8 of the heel (for clarity, the portion of the chain of cleats between those shown are merely represented by dash lines). The rearward heel portion 8 is conventionally equipped with furrows 9 extending transversely across the width of the sole. The cleat-like projections 5 and 6 are arranged in the inner part 10 of the sole, surrounded by the projections 3 and 4 in the manner of a link chain.

The projections 3, as illustrated in FIG. 1, are located in the region of the tip of the shoe with approximately five of these projections converging conically toward the inner part 10 of the sole. As further shown in FIG. 5, each projection 3 exhibits a rugged, claw-like blade 11 in the zone of the sole rim 7 and two inner blades 12 and 13 which slope away from rim 7 and are fashioned to be weaker than blade 11.

Numeral 14 denotes a part of the tread sole 1 attached to the tip of the shoe, which part is curved upwardly over the tip of the shoe shank and represents a toe protection. The part 14, preferably equipped with transverse furrows just as part 8, passes over practically without transition into the first blade 11 of the cleat-like projection 3.

FIG. 2 shows a projection 5 from the inner part 10 of the sole in a sectional view, one diagonal of this projection extending approximately in the direction of the longitudinal axis 15 of the sole and the other diagonal of this projection extending obliquely to this axis. The two outer blades 16 of projection 5 constitute the ends of a tubular section having approximately a crescent shape, accommodating therein a smaller, likewise crescent-shaped tubular section provided with the blades 17. The blades 16 and 17 may lie at the same level, but they can also exhibit differing heights to increase the shock-absorbing effect, as illustrated in FIG. 2. The difference in height in this case is denoted by "x" and can range between 1 and 2 mm, depending on the purpose for which the article is used.

FIG. 3 shows one of the projections 4 in a cross-sectional view, as they are arranged outside of the inner part 10 of the sole, namely at the sole rim 7. The construction and shape of this projection are similar to those of the projections 5. However, in this embodiment, the outer blades 18 and 19 are longer than the two inner blades 20. Furthermore, the outer blade 18 projects by the amount "y" of 1–3 mm past the outer sole rim 7, whereby the gripping and shock-absorbing effect against lateral slipping is further enhanced. Additionally, the outermost and innermost blades, instead of being crescent-shaped with convex and concave surfaces as blades 16, merely have concave inner surfaces with planar, inclined outer surfaces.

The cleat-like projections 4 are arranged along the sole rim 7 in the manner of a link chain and are fashioned in this embodiment in the form of a rectangle, the large side of the rectangle being about 2 cm and the small side of the rectangle being about 1 cm in length, and the height of the blades 18, 19, 20 amounting to between about 3 and 8 mm. The mutual space "z" (see FIG. 1) is about 2–5 mm.

FIG. 4 illustrates a projection 6, arranged only in the inner part 10 of the sole, having blades 21 passing over one to another in a trough-like configuration. These blades 21 are primarily located in the interspaces of the inner part 10 of the sole formed by the larger projections 5, in order to avoid sagging of the tread sole in these regions and also to increase gripping of the sole with the ground.

The present invention is not limited to the illustrated embodiment or the described types of cleats. The invention may be modified in various ways, without departing from the actual idea of this invention. Thus, it is contemplated, for example, to provide projections 4 having the configuration of a square or some other polygon, instead of using rectangular projections. It is likewise feasible to entirely omit the mutual spacings "z" of the projections 3 and/or 4, at least at certain locations, or to vary these spacings in some other manner, so that the desired sole flexibility in the longitudinal direction of the sole is not impaired.

It is furthermore contemplated that, instead of manufacturing the projections and the tread sole from a single piece, the projections may be cast into the tread sole or vulcanized onto the tread sole.

The invention can be utilized especially for jogging shoes, without being limited to such use. Other fields of usage are, in particular, the various types of training shoes.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

What is claimed is:

1. Athletic shoe, especially a jogging shoe, with a tread sole formed of rubber or a rubber-like synthetic resin, the sole being provided at least partially with cleat-like projections distributed over the tread surface remote from the periphery of the sole and additional cleat-like projections sub-divided in the manner of a link chain distributed along a rim of the sole, characterized in that the cleat-like projections are equipped on contact surfaces on a bottom side thereof with blade-like projections which are constructed for increasing the shock-absorbing effect and simultaneously enhancing the gripping effect of the sole, said blade-like projections of each cleat-like projection extending essentially in parallel to one another.

2. Athletic shoe according to claim 1, characterized in that the height of the additional cleat-like projections increases from the inner part of the sole toward the rim of the sole.

3. Athletic shoe according to claim 1 or 2, characterized in that an outermost blade of the cleat-like projections distributed along the rim of the sole project past the sole rim.

4. Athletic shoe according to claim 3, characterized in that cleat-like projections of the inner part of the sole are at least in part of a rectangular or square basic configuration.

5. Athletic shoe according to claim 1 or 2, characterized in that cleat-like projections of the inner part of the sole are at least in part of a rectangular or square basic configuration.

6. Athletic shoe according to claim 1 or 2, characterized in that the additional cleat-like projections arranged along the sole rim have a length of about 2 cm, a width of 1 cm, and a height of 3–8 mm, and the mutual spacing between adjacent cleat-like projections is about 2–5 mm.

7. Athletic shoe according to claim 3, characterized in that the additional cleat-like projections arranged along the sole rim have a length of about 2 cm, a width of 1 cm, and a height of 3–8 mm, and the mutual spacing between adjacent cleat-like projections is about 2–5 mm.

8. Athletic shoe according to claim 4, characterized in that the additional cleat-like projections arranged along the sole rim have a length of about 2 cm, a width of 1 cm, and a height of 3–8 mm, and the mutual spacing between adjacent cleat-like projections is about 2–5 mm.

9. Athletic shoe according to claim 1 or 2, wherein some of said additional cleat-like projections are arranged along lateral portions of the sole rim, and characterized in that those additional cleat-like projections arranged along lateral portions of the sole rim are provided with blades arranged in pairs with respect to one another, of which at least one blade pair is oriented toward the inner part of the sole and at least one blade pair is oriented outwardly away from the inner part.

10. Athletic shoe according to claim 9, characterized in that an outermost blade of the cleat-like projections distributed along the rim of the sole project past the sole rim.

11. Athletic shoe according to claim 5, wherein some of said additional cleat-like projections are arranged along lateral portions of the sole rim, and characterized in that those additional cleat-like projections arranged along lateral portions of the sole rim are provided with blades arranged in pairs with respect to one another, of which at least one blade pair is oriented toward the inner part of the sole and at least one blade pair is oriented outwardly away from the inner part.

12. Athletic shoe according to claim 11, characterized in that an outermost blade of the cleat-like projections distributed along the rim of the sole project past the sole rim.

13. Athletic shoe according to claim 1, characterized in that those of the additional cleat-like projections arranged in a zone of the tip of the shoe are provided with at least two claw-shaped blades of different size, of which a largest one of the blades is arranged directly at the sole rim and the remainder of the blades are oriented toward the inner part of the sole.

14. Athletic shoe according to claims 1 or 2 or 13, characterized in that the cleat-like projections are unitary portions of the tread sole.

15. Athletic shoe according to claim 9, characterized in that the cleat-like projections are unitary portions of the tread sole.

16. Athletic shoe according to claim 1, characterized in that the axes of the cleat-like projections arranged at the inner part of the sole extend obliquely to the central longitudinal axis of the sole.

17. Athletic shoe according to claim 9, characterized in that some of the cleat-like projections of the inner part of the sole have double blade pairs.

18. Athletic shoe according to claim 17, wherein the cleat-like projections arranged along the longitudinal axis of the sole have double blade pairs.

19. Athletic shoe according to claim 17, characterized in that some of the cleat-like projections of the inner part of the sole have a single blade pair.

20. Athletic shoe according to claim 19, wherein said single blade pair forms a trough-like configuration.

21. Athletic shoe according to claim 19 or 20, wherein the cleat-like projections with double blade pairs are larger than those with a single blade pair and said projections with a single blade pair are located in interspaces formed by the projections with double blade pairs.

22. Athletic shoe according to claim 17, wherein each blade pair of the projections of the inner part of the sole having double blade pairs constitutes the ends of a cross section of approximately crescent shape.

23. Athletic shoe according to claim 22, wherein the height of an inner one of said double blade pairs is less than that of an outer one of said double blade pairs.

* * * * *